US009119457B2

(12) United States Patent
Ooba

(10) Patent No.: US 9,119,457 B2
(45) Date of Patent: Sep. 1, 2015

(54) COLLECTOR-TYPE APPLICATOR IMPLEMENT

(71) Applicant: MITSUBISHI PENCIL COMPANY, LIMITED, Tokyo (JP)

(72) Inventor: Shigeki Ooba, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/282,666

(22) Filed: May 20, 2014

(65) Prior Publication Data

US 2014/0348568 A1 Nov. 27, 2014

(30) Foreign Application Priority Data

May 21, 2013 (JP) ..... 2013-106739
Apr. 22, 2014 (JP) ..... 2014-088205

(51) Int. Cl.

| | |
|---|---|
| ***B43K 5/18*** | (2006.01) |
| ***A45D 34/04*** | (2006.01) |
| *B43K 5/10* | (2006.01) |
| *B43K 8/04* | (2006.01) |

(52) U.S. Cl.

CPC ..... *A45D 34/04* (2013.01); *A45D 2200/1072* (2013.01); *B43K 5/10* (2013.01); *B43K 5/18* (2013.01); *B43K 5/1809* (2013.01); *B43K 8/04* (2013.01)

(58) Field of Classification Search

USPC ..... 401/222–227

See application file for complete search history.

(56) References Cited

U.S. PATENT DOCUMENTS 5,217,313 A * 6/1993 Tamura et al. ..... 401/48
5,938,362 A * 8/1999 Bastiansen ..... 401/209

FOREIGN PATENT DOCUMENTS

| | | | |
|---|---|---|---|
| JP | 8-10405 | Y2 | 3/1996 |
| JP | 10-119479 | A | 5/1998 |
| JP | 2005-7740 | A | 1/2005 |

* cited by examiner

*Primary Examiner* — David Walczak

(74) *Attorney, Agent, or Firm* — Birch, Stewart, Kolasch & Birch, LLP

(57) ABSTRACT

A collector-type applicator implement includes: a barrel body having a front barrel and a main barrel on a rear side of the front barrel, the main barrel being fitted with the front barrel; a collector having comb-like fins and arranged in a front part of the barrel body; and, a storage space defined in a rear part of the barrel body for storing an application liquid. The collector is covered by front barrel and the main barrel and configured to be held inside the barrel body.

6 Claims, 14 Drawing Sheets

16a
26

16a
16b
28
28
28
28
16c
28

16a
16b
24
16c
16d
26

16a
16b
28
28
16c
28
26

16a
16b
24
28
28
28
16c
28

26
16d
28

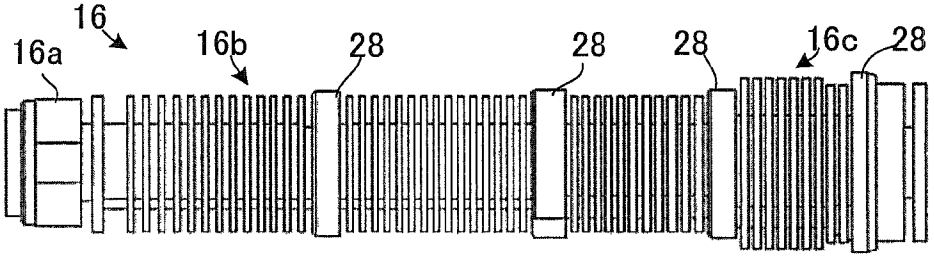
FIG. 11D
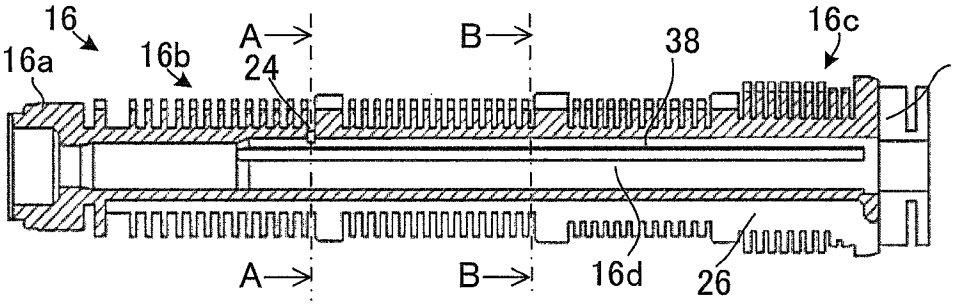
FIG. 11E
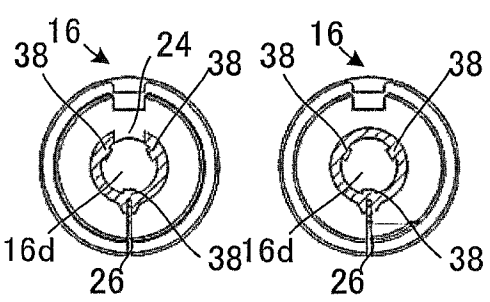
FIG. 11B
FIG. 11A

FIG. 11H
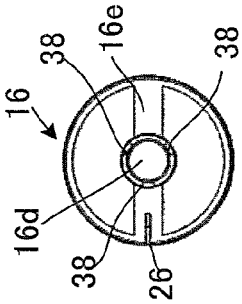
FIG. 11F
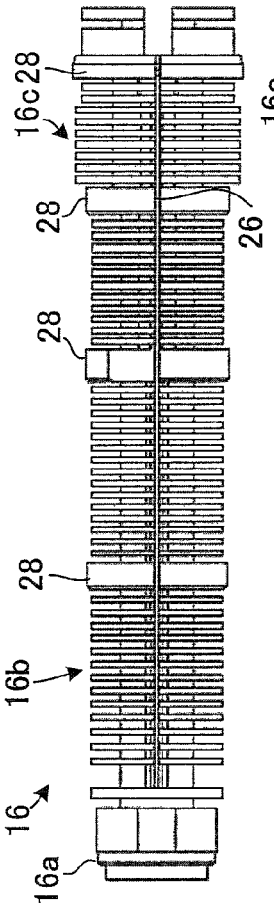
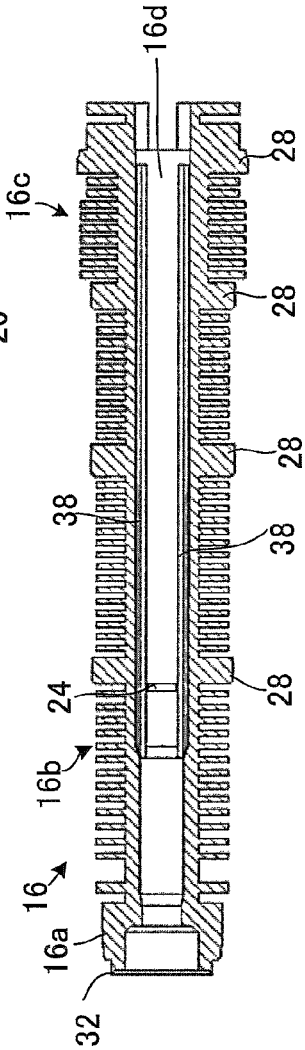
FIG. 11G
FIG. 11C
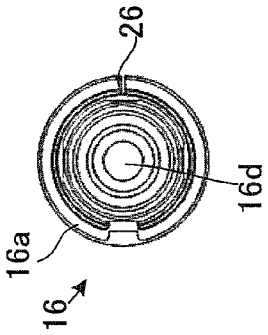

COLLECTOR-TYPE APPLICATOR IMPLEMENT

This Nonprovisional application claims priority under 35 U.S.C. §119(a) on Patent Application No. 2013-106739 filed in Japan on 21 May 2013 and Patent Application No. 2014-088205 filed in Japan on 22 Apr. 2014, the entire contents of which are hereby incorporated by reference.

BACKGROUND OF THE INVENTION (1) Field of the Invention

The present invention relates to a collector-type applicator implement that stores a low-viscosity cosmetic liquid, in particular, relating to an eyeliner of which stylish appearances are important.

(2) Description of the Prior Art

Conventionally, collector-type applicators have been well-known technologies, and since carriage performance and design are regarded as important factors for the diverse demands on the market, slender applicator implements have been preferred.

The collector-type applicator implement can provide a stable amount of flow from beginning to end of use compared to the applicator implement that uses a sliver in the ink tank. However, since it is necessary to assure a certain amount of ink retention and air replacement, the collector needs to have a certain volume, posing difficulties in producing slender applicator implements.

Under such circumstances, a collector-type applicator implement aiming at solving the problem or providing a configuration with a small outside diameter has been disclosed (Japanese Utility Model Publication H08-10405 (Patent Document 1)).

Also disclosed as to miniaturization has been a collector-type writing implement in which the distance between fins in the collector is 0.1 mm to 0.5 mm (see Paragraph [0017] in Japanese Patent Application Laid-open 2005-7740 (Patent Document 2)).

There has been also disclosed a writing implement whose collector has an outside diameter of 7 mm to 8 mm and a full length of 20 mm to 28 mm (see Paragraphs [0015] and [0016] in Japanese Patent Application Laid-open H10-119479 (Patent Document 3)).

PRIOR ART DOCUMENTS

Patent Documents

Patent Document 1:
Japanese Utility Model Publication H08-10405
Patent Document 2:
Japanese Patent Application Laid-open 2005-7740
Patent Document 3:
Japanese Patent Application Laid-open H10-119479

Nevertheless, in the collector-type applicator implement of Patent Document 1, since the ink tank needs to be connected, there occurs the problem that the collector becomes thick.

Further, the collector-type applicator implement of a narrow barrel suffers the forward leakage problem and the flooding problem. On the other hand, when a large collector is used, the amount of application markedly decreases so that the distance by which application can be performed becomes short.

That is, it has been difficult to realize an applicator implement of a narrow barrel that has an outside diameter of 9 mm or less and can store a low-viscosity application liquid, as described in Patent Document 3.

SUMMARY OF THE INVENTION

It is therefore an object of the present invention to provide a collector-type applicator implement that is of a narrow barrel type but free from leakage of application liquid.

The present invention resides in a collector-type applicator implement comprising:

a barrel body comprising:

a front barrel; and a main barrel on a rear side of the front barrel, the main barrel being fitted with the front barrel;

a collector having comb-like fins and arranged in a front part of the barrel body; and, a storage space defined in a rear part of the barrel body for storing an application liquid, wherein the collector is covered by the front barrel and the main barrel and configured to be held inside the barrel body.

In the present invention, it is preferred that an outside diameter in a rear part of the collector is greater than an outside diameter in a front part of the collector.

In the present invention, it is also preferred that a thick supporting wall abutting an inner surface of the front barrel are formed every plural number of fins of the collector, and the outside diameter of the collector is varied stepwise by the thick supporting wall.

In the present invention, it is preferred that an outer periphery of the front part of the collector is put in hermetic contact with an inner wall of the front barrel.

In the present invention, it is preferred that the collector-type applicator implement further includes a center core disposed inside the collector to lead the application liquid from the storage space to a writing part, and that the center core is not projected from a rear end of the collector into the storage space.

In the present invention, it is preferred that an elastic thin projection is formed in a front end of the collector that abuts the writing part.

In the present invention, it is preferred that the collector-type applicator implement further includes a center core disposed inside the collector to lead the application liquid from the storage space to a writing part, and that a plurality of ribs are provided in a hollow portion of the collector and projected inwardly in the hollow portion, and the center core is inserted in the hollow portion. Also, it is preferred that the hollow portion is connected to a through hole and an ink groove communicating through each ink temporary collecting portion is arranged on the collector at an opposite side of the through hole.

Advantages of the Invention

According to the applicator implement of the invention, in the collector-type applicator implement, the collector is configured to be held by the front barrel and the barrel body so that the collector is projected from the front barrel to thereby secure a necessary amount of ink storage. As a result, it is possible to realize an applicator implement of a narrow barrel that can make the best use of inherent performance of the collector.

Here, use of the collector having a greater outside diameter in the rear part thereof than that of the front part, makes it possible to realize an applicator implement of a narrow barrel that can make the best use of inherent performance of the collector. Further, by providing the thick supporting wall abutting the inner surface of the front barrel every plural number of fins of the collector while varying the outside diameter of the collector stepwise at the supporting wall, it is possible to easily form the tapered shape in the front barrel. Also, provision of the supporting walls makes it possible to improve separation performance in molding.

Further, placing the outer periphery of the front part of the collector in hermetic contact with the inner wall of the front barrel, makes it possible to prevent the application liquid from leaking from the applying part while increasing the volume of the application liquid correction portion inside the front barrel.

In the present invention, use of the capillary member, i.e., the center core that is not projected from the rear end of the collector into the storage space, makes it possible to increase the stored amount of application liquid in the barrel.

Formation of the annular thin elastic projection annularly abutting the rear endface of the writing part along the collector's front end connected to the writing part, makes it possible to flexibly fix the writing part by the elastic force of the elastic projection.

In the present invention, by forming a plurality of ribs projected inwards inside the hollow portion of the collector so as to support the center core that is inserted in this hollow portion while creating clearance between the center core and the inner surface of the hollow portion, this configuration of the clearance facilitates air replacement, hence contributes to improvement in application performance of the application liquid.

According to the present invention, it is possible to provide a thin-barrel applicator implement, especially eyeliner, which can present equivalent performance to that of the conventional thick-barrel applicator implement. When used as an eyeliner, this thin-barrel collector-type applicator implement presents stylish appearances and enables the user to apply thick and clear eye-line until end of use thanks to the adoption of a collector configuration.

BRIEF DESCRIPTION OF THE DRAWINGS

FIG. 11A is a cross-section cut along line A-A in FIG. 11E of a collector of the same collector-type applicator implement, FIG. 11B a cross-section cut along line B-B in FIG. 11E, FIG. 11C a front view of the same, FIG. 11D a side view of the same, FIG. 11E a vertical section of the same, FIG. 11F a side view from the slit side of the same, FIG. 11G a vertical section of the state of FIG. 11F, and FIG. 11H a rear view of the same; and, FIG. 12A is a perspective view from the front of the collector of the same collector-type applicator implement, and FIG. 12B a perspective view from the rear of the same.

DESCRIPTION OF THE PREFERRED EMBODIMENTS

The embodiments of the present invention will be described hereinbelow with reference to the drawings.

Figure 1A:
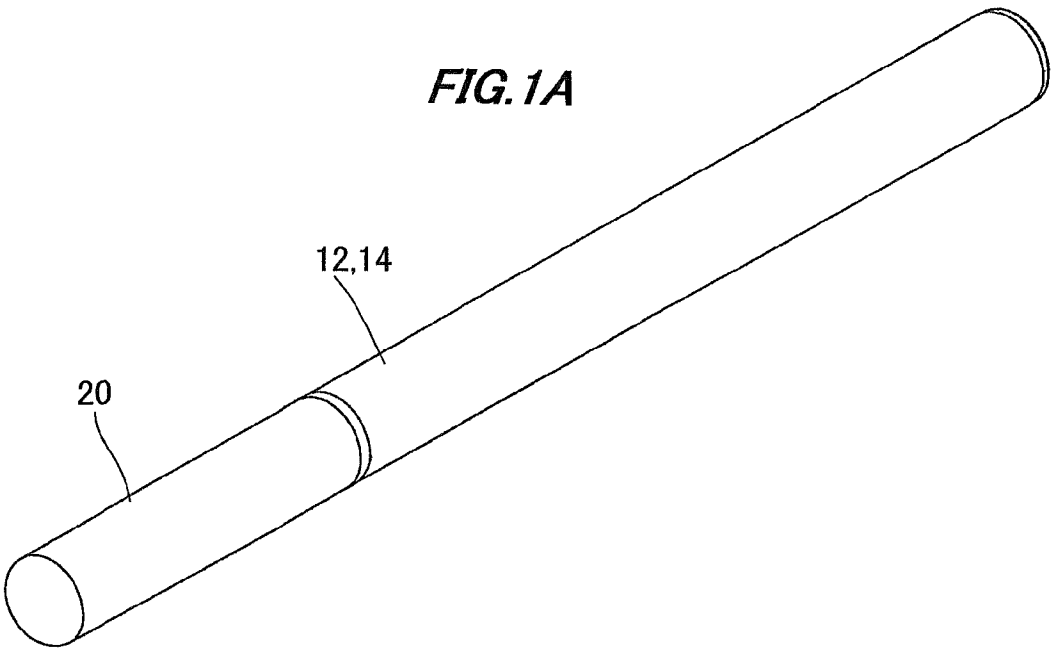
FIG. 1A is an overall perspective view of a collector-type applicator implement according to the first embodiment of the present invention, and FIG. 1B an overall section of the same.
Figure 1B:
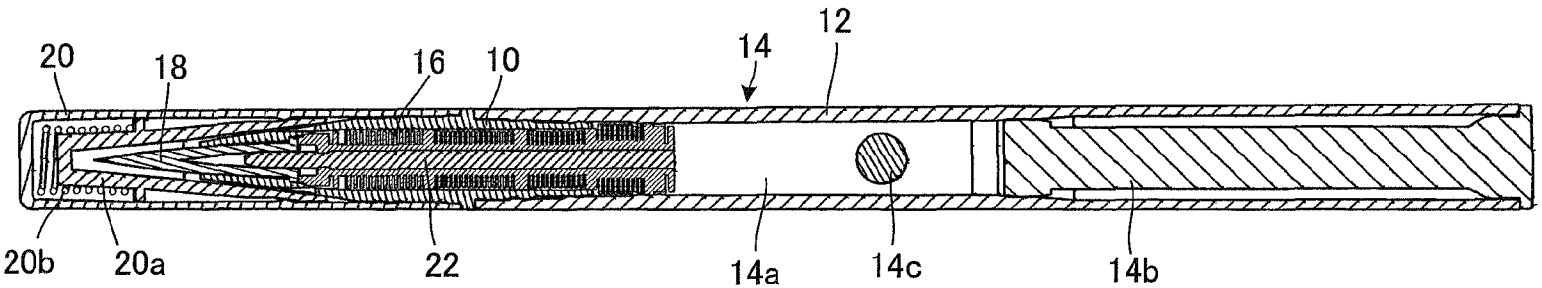
Figure 2A:
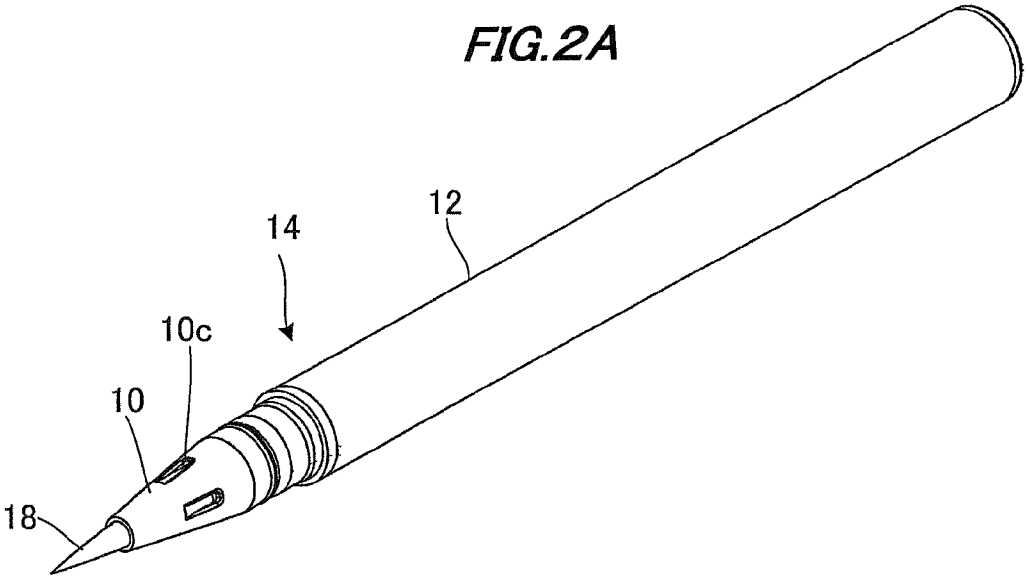
FIG. 2A is an overall perspective view showing the same collector-type applicator implement with its cap removed, and FIG. 2B an overall section of the same.
Figure 2B:
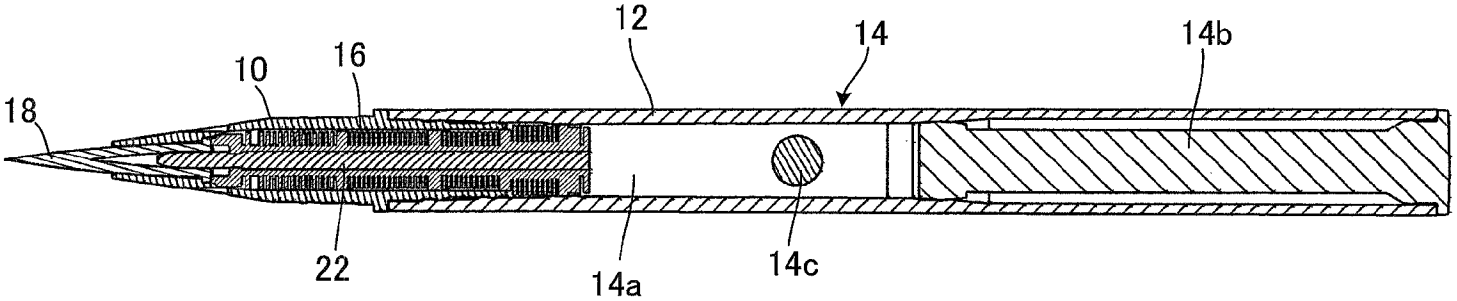
Figure 6B:
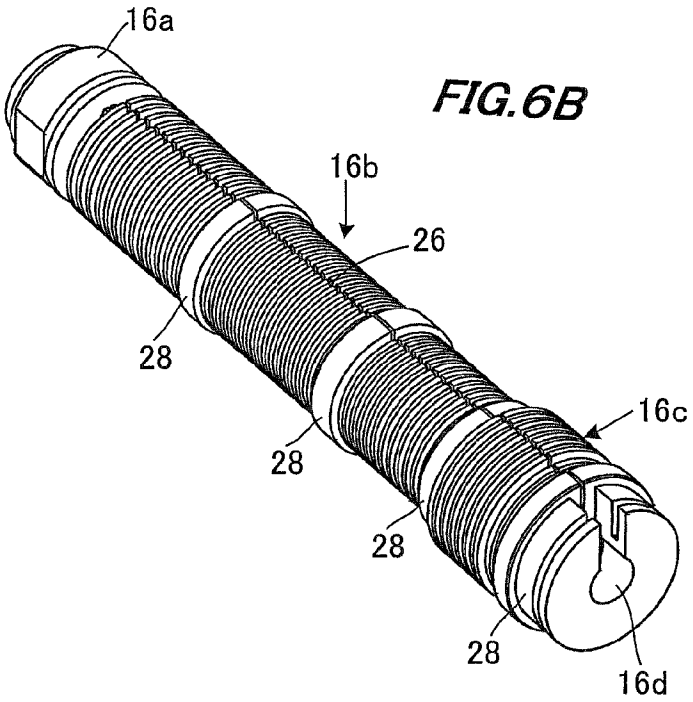
FIG. 6A is a perspective view from the front of a collector of the same collector-type applicator implement, and FIG. 6B a perspective view from the rear of the same.
Figure 6A:
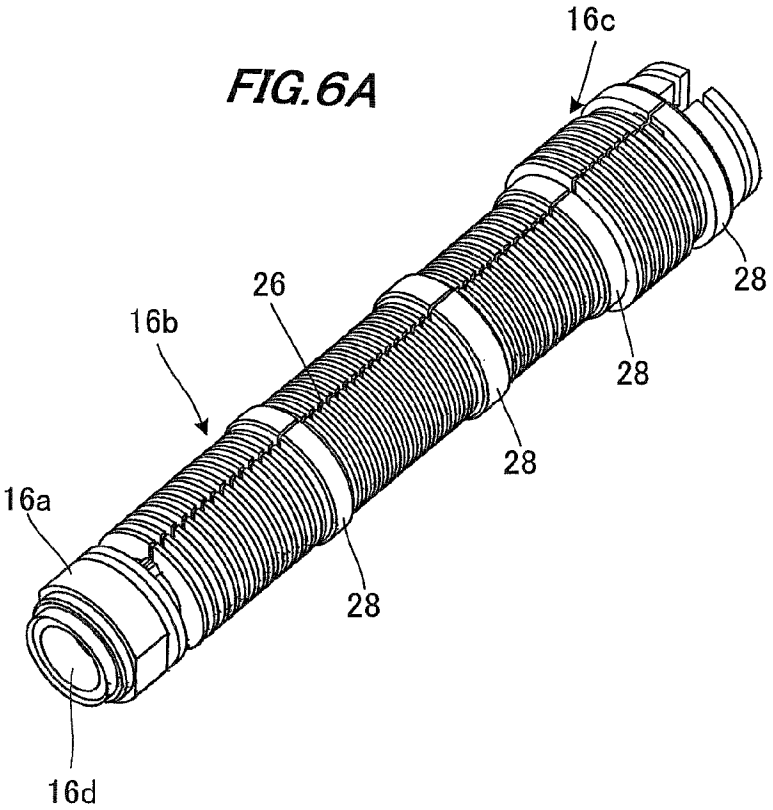

FIGS. 1A and 1B are overall illustrative diagrams of a collector-type applicator implement according to the first embodiment of the present invention; FIGS. 2A and 2B are illustrative diagrams showing the collector-type applicator implement with its cap removed; FIGS. 3A to 3D are part drawings of the writing part side of the collector-type applicator implement; FIGS. 4A to 4E are part drawings of a front barrel; FIGS. 5A to 5F are part drawings of a collector; and, FIGS. 6A and 6B are perspective views of the collector.

As shown in FIGS. 1A to 3D, the corrector-type applicator implement according to the first embodiment is a collector-type applicator implement including: a barrel body 14 of a front barrel 10 and a main barrel 12 on the rear side of the front barrel 10, being fitted together; a collector 16 formed of a plurality of comb-like fins, each of which forms a leaf-like sheet member, arrayed in the axial direction in the front part of barrel body 14; a storage space 14*a* in the rear part inside barrel body 14 for storing an application liquid.

Main barrel 12 in the rear part of the barrel body 14 has a pipe-like configuration open at both ends to establish communication therethrough. At the rear end of main barrel 12, which is also the rear end of barrel body 14, a tail plug 14*b* is fitted to close the rear part of main barrel 12. The space inside barrel body 14 (which is also the space inside main barrel 12) defined between the front end of the tail plug 14*b* and the rear end of collector 16 forms the storage space 14*a*.

Freely stored inside this storage space 14*a* is the application liquid without provision of any impregnation material such as a sliver while an agitator (ball or the like) 14*c* for stirring the application liquid is disposed.

Front barrel 10, main barrel 12, collector 16, cap 20, etc. may be formed of resin moldings. Agitator 14*c* may be a ball part made of metal, resin or the like.

The collector 16 is covered and supported by front barrel 10 and main barrel 12.

A writing part 18 of a tapered brush body is projected from the opening at the front end of front barrel 10. A cap 20 that covers the writing part 18 is removably fitted to the front barrel 10. The front barrel 10 has an approximately frusto-conical shape, tapering to the front. The vertex angle of the front barrel 10 is preferably formed to be approximately equal to the vertex angle of writing part 18.

Writing part 18 is a tapered brush body formed of a resin fabric, a bundle of natural fibers, or a resin porous material. Writing part 18 has a flange-like large-diametric part in the rear end. This large-diametric part is engaged with the interior of front barrel 10 so that the writing part will not come off. Here, a brush is preferable as writing part 18, but various kinds of applying parts for applying the application liquid may be used.

Inside cap 20, a cup-shaped inner cap 20*a* covering writing part 18 with enhanced airtightness is arranged so as to be movable back and forth while a spring 20*b* that urges this inner cap 20*a* rearwards is disposed.

Inside hollowed and tapered front barrel 10, bellows-like collector 16 is arranged in the rear of writing part 18. A center core 22 is penetrating through a hollow portion 16*d* of this collector 16. Center core 22 can be formed of a capillary member such as a resin fiber bundle, natural fiber bundle, resin porous material, or the like.

As to center core 22, the center core 22 is not projected from the rear end of collector 16 into storage space 14*a* of barrel body 14 (see FIGS. 1A to 2B). The rear endface of center core 22 is approximately flushed with the rear endface of collector 16. This flushness of center core 22, or no part of center core 22 sticking out inside storage space 14*a*, can secure the volume of storage space 14*a*. Further, since the rear end of center core 22 does not stick out inside storage space 14*a*, in a configuration where agitator 14*c* is put inside storage space 14*a* and if agitator 14*c* is moved inside storage space 14*a*, the agitator will not collide with center core 22 and deform center core 22, hence it is possible to impregnate the center core adequately with the application liquid.

The outer peripheral surface of front barrel 10 is tapered in the front end, and has a flange 10*a* projected in its center radially outwards for positioning cap 20 when it is fitted, and a projection 10*b*1 for fitting cap 20 is formed to swell in the front of flange 10*a* and a projection 10*b*2 for fitting main barrel 12 is formed to swell in the rear of flange 10*a*. Further, air replacement holes 10*c* passing through the peripheral wall from the inside to the outside are formed in the front of projection 10*b*1 of front barrel 10 (see FIGS. 3A to 3D).

As shown in FIGS. 5A to 6B, collector 16 has a bowl-shaped part 16*a* formed at the front end in its front part in the axial direction. Further, a front temporary collecting portion 16*b* of a plurality of comb-like fins spaced at intervals is arranged from the front to the center of collector 16 with respect to the axial direction while a rear temporary collecting portion 16*c* is formed in the rear part of collector 16 with respect to the axial direction.

As described, center core 22 is provided inside collector 16. In this embodiment, a wall portion is formed near the axial center of collector 16 so that hollow portion 16*d* is formed inside the wall portion, penetrating through the center of the wall portion. On the outer peripheral surface of the wall portion defining this hollow portion 16*d*, fins for temporal collection of the application liquid (front temporary collecting portion 16*b* and rear temporary collecting portion 16*d*) are formed. These fins are a plurality of thin plates or leaf-like sheet members extending in the radial direction. A through hole 24 that enables the application liquid to flow between the hollow portion 16*d* and the spacing between the fins are formed through this wall portion in the radial direction from the outer periphery to the inner periphery or hollow portion 16*d*.

The through hole 24 is formed adjoining to a supporting wall 28. Detailedly, through hole 24 is formed in the wall portion between supporting wall 28 and the closet fin to the supporting wall 28.

As to the relationship with the formed position of an ink groove (slit) 26, the through hole 24 is formed on the opposite side across the shaft of collector 16 from that of ink groove 26.

Further, the aforementioned ink groove (slit) 26 for leading the application liquid into the fin spacings is formed from the front temporary collecting portion 16*b* to the rear temporary collecting portion 16*c* and the rear end of the groove (slit) 26 is opened (and is able to be exposed to storage space 14*a* in barrel body 14).

Thick supporting walls 28 that abut the inner surface of front barrel 10 are arranged appropriately every multiple number of fins or are arranged between the front temporary collecting portion 16*b* having a plurality of fines and the rear temporary collecting portion 16*c* having a plurality of fines.

Specifically, the number of fins of front temporary collecting portion 16*b* and rear temporary collecting portion 16*c* is 40 to 60 in total. Among these, front temporary collecting portion 16*b* includes 75 to 85% of these and rear temporary collecting portion 16*c* includes 15 to 25%. The spacing between fins may be specified to be 0.15 to 0.3 mm.

The storage capacity of storage space 14*a* is specified to be 0.7 (ml). The outside diameter of barrel body 14 is 8.5 (mm) and the diameter of collector 16 is 6.0 (mm).

Figures 3A, 3B, 3C, 3D:
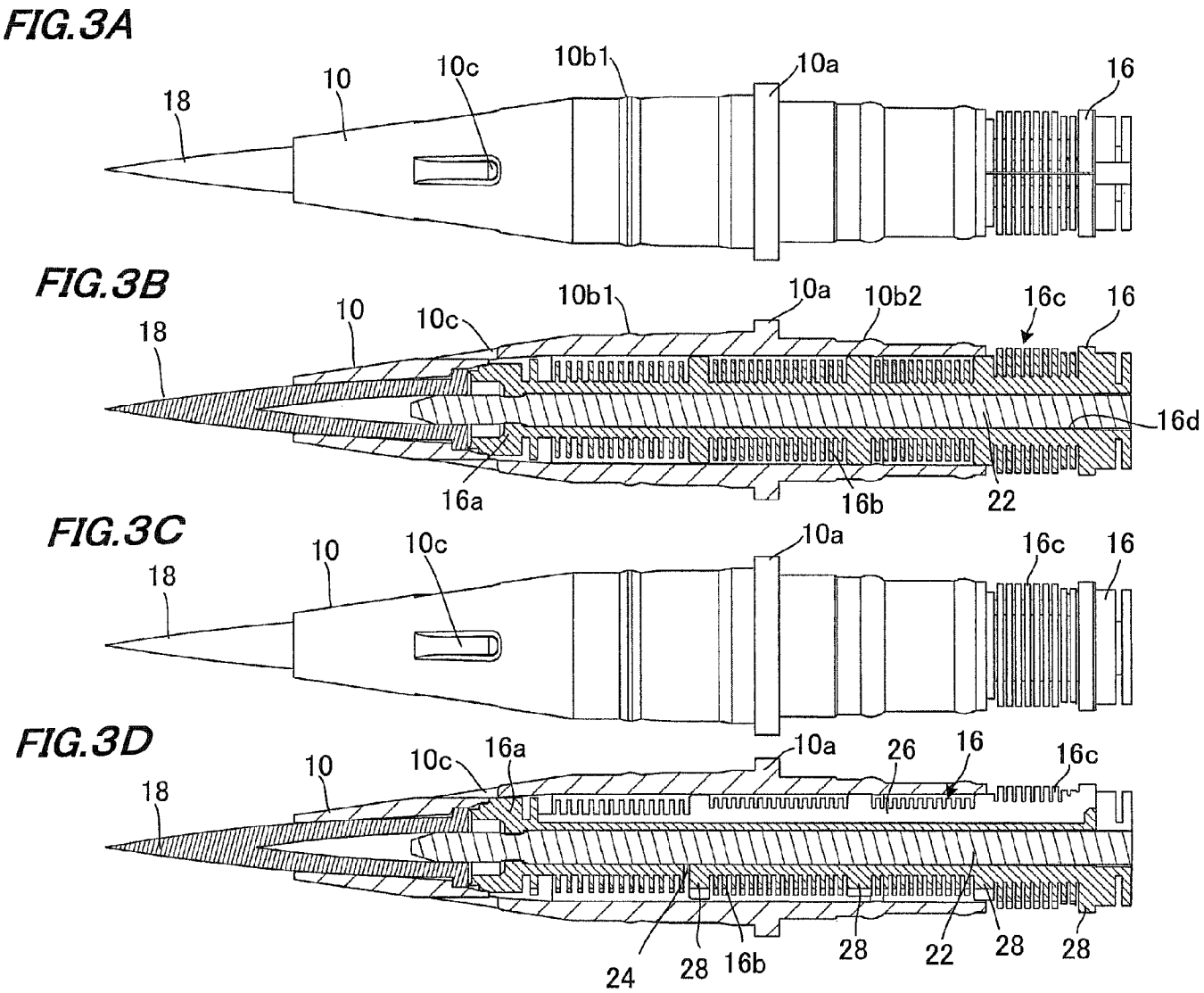
FIG. 3A is a side view from the slit side of the same collector-type applicator implement, FIG. 3B a vertical section of the same, FIG. 3C a side view rotated 90° from the state of FIG. 3A, and FIG. 3D a vertical section of the same.
Figures 4A, 4B, 4C, 4D, 4E:
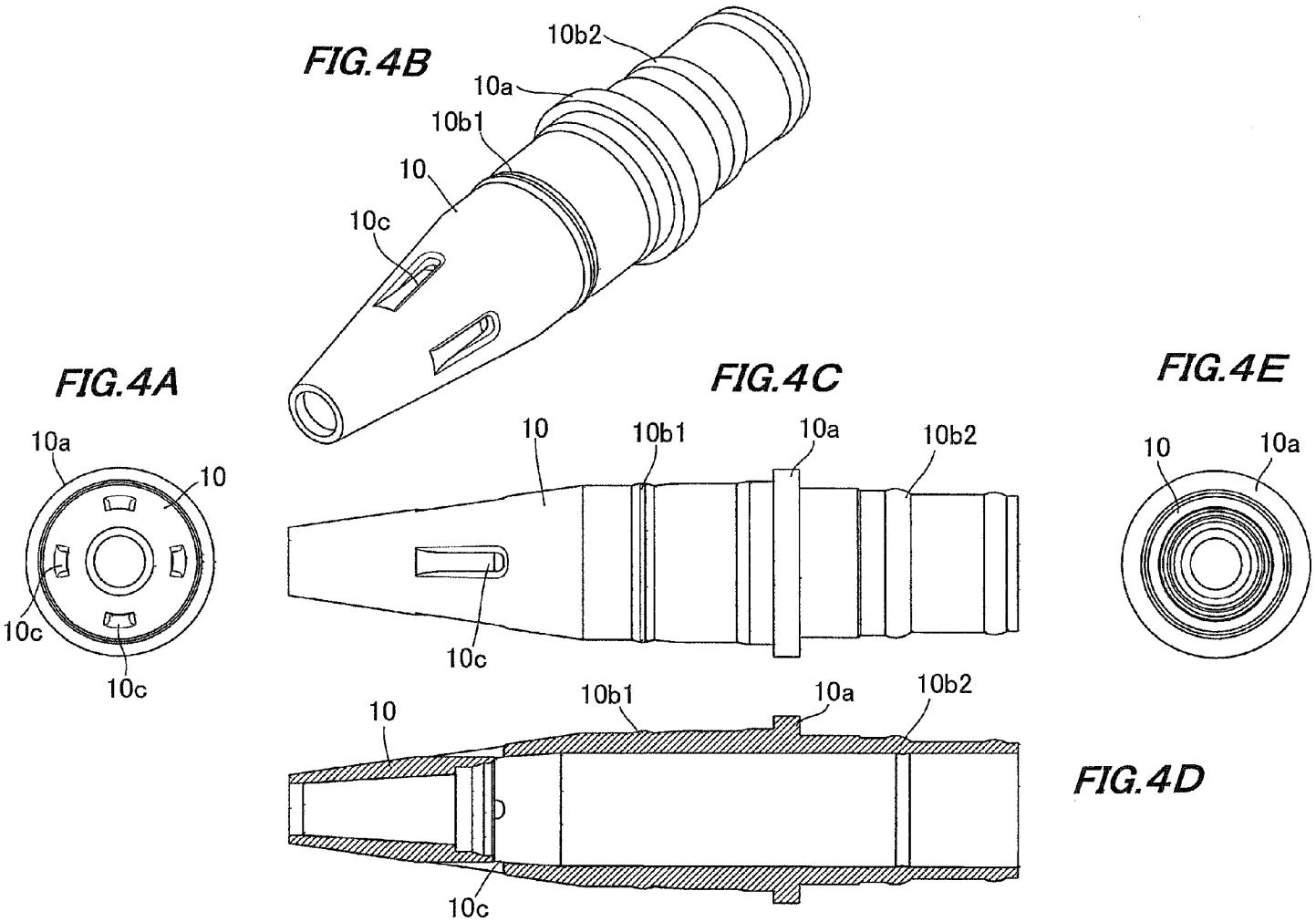
FIG. 4A is a front view of a front barrel of the same collector-type applicator implement, FIG. 4B a perspective view of the same, FIG. 4C a side view of the same, FIG. 4D a vertical section of the same, and FIG. 4E a rear view of the same.
Figures 5A, 5B, 5C, 5D, 5E, 5F:
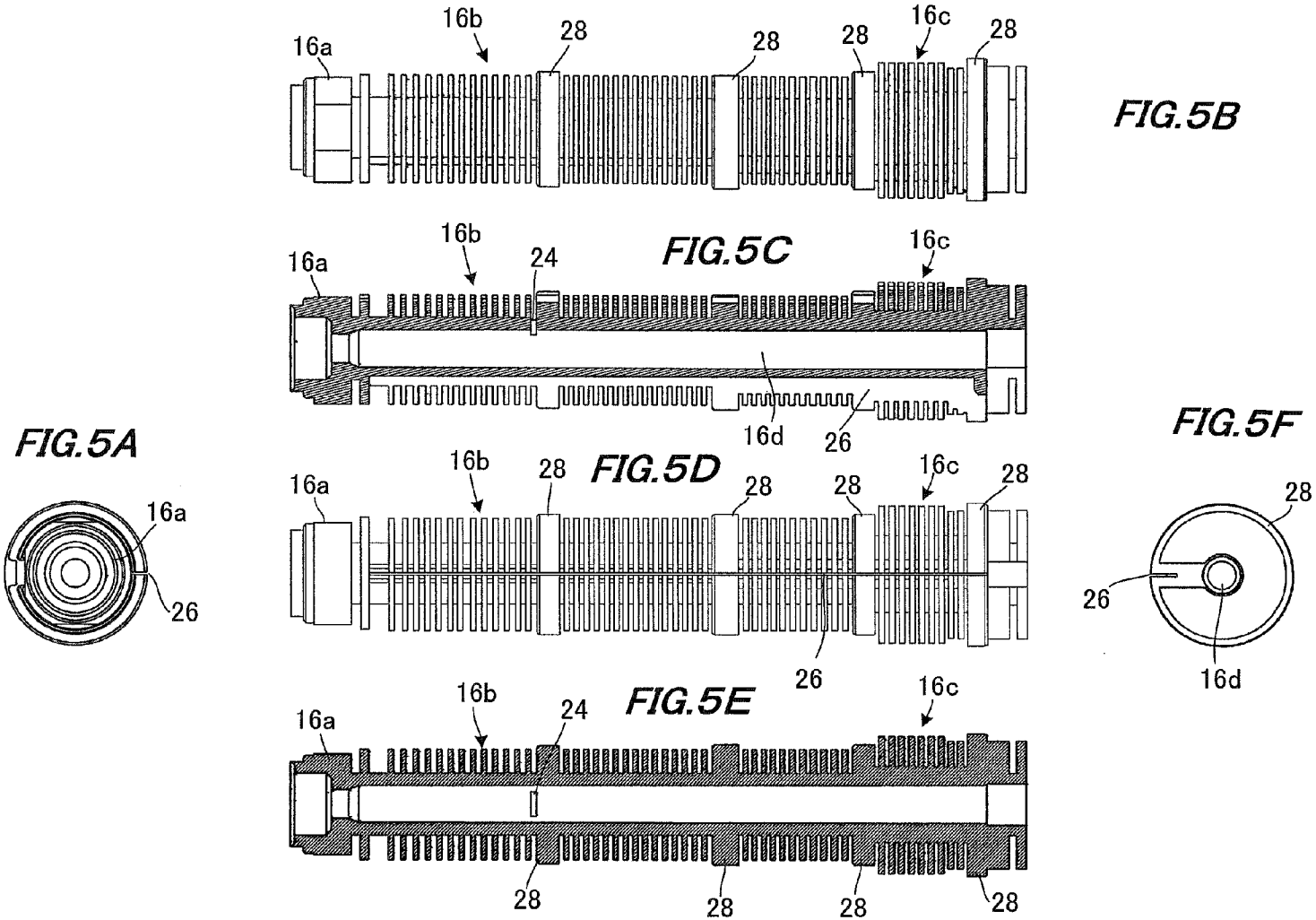
FIG. 5A is a front view of a collector of the same collector-type applicator implement, FIG. 5B a side view of the same, FIG. 5C a vertical section of the same, FIG. 5D a side view from the slit side, FIG. 5E a vertical section of the state of FIG. 5D, and FIG. 5F a rear view of the same.

The aforementioned front temporary collecting portion 16*b* is formed with the same diameter as that of the bowl-shaped part 16*a*, and inserted in front barrel 10 as shown in FIGS. 3B and 3D. The aforementioned rear temporary collecting portion 16*c* is formed to be greater in outside diameter than front temporary collecting portion 16*b*, and positioned being projected from the rear end of front barrel 10, as shown in FIGS. 3A to 3D, and arranged in adjacent to the interior wall surface of main barrel 12, as shown in FIG. 1B and others.

The Second Embodiment

Figure 7A:
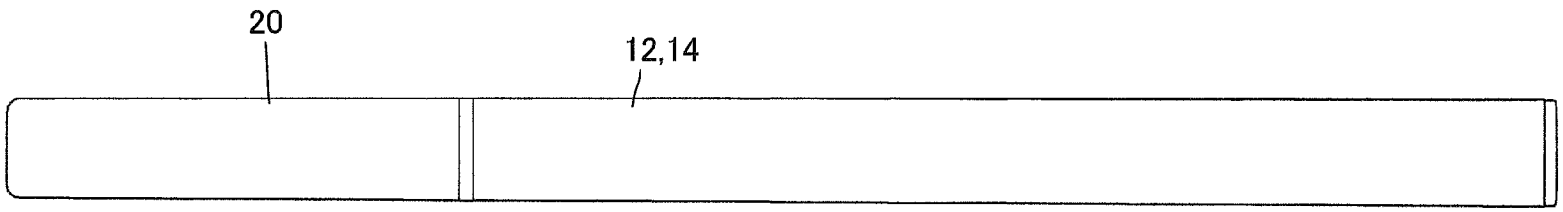
FIG. 7A is an overall side view of a collector-type applicator implement according to another embodiment (the second embodiment) of the present invention, and FIG. 7B an overall vertical section of the same.
Figure 7B:
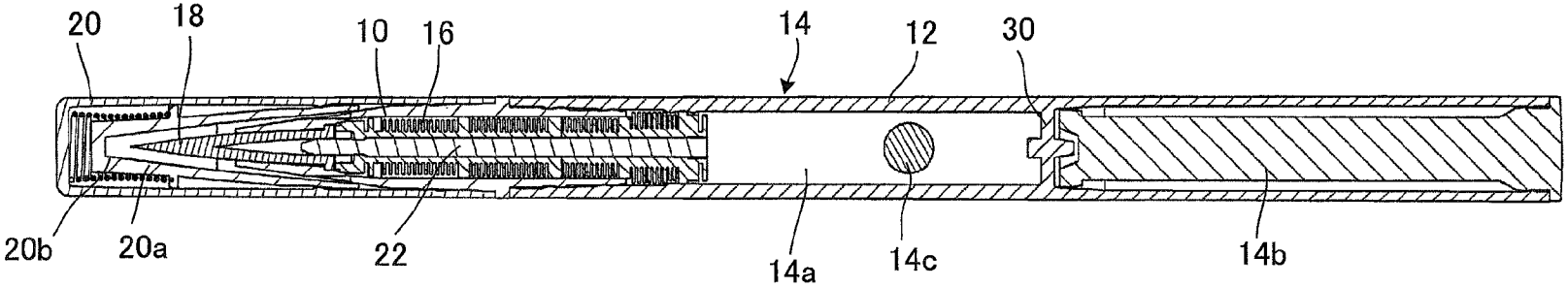
Figure 8A:
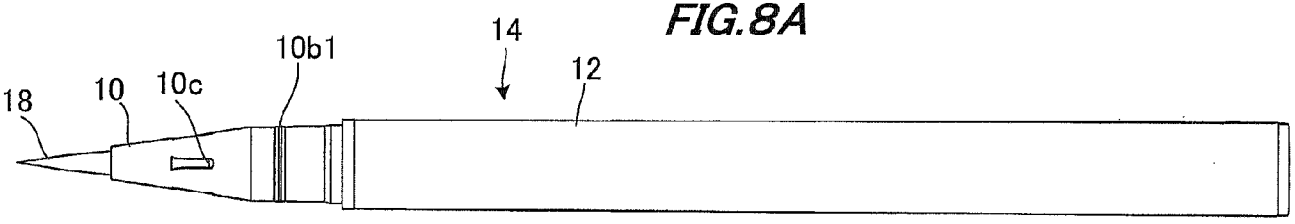
FIG. 8A is an overall side view showing the collector-type applicator implement of FIG. 7A with its cap removed, and FIG. 8B an overall vertical section of the same, and FIG. 8C an enlarged vertical section of a portion from the writing part to the collector.
Figure 8B:
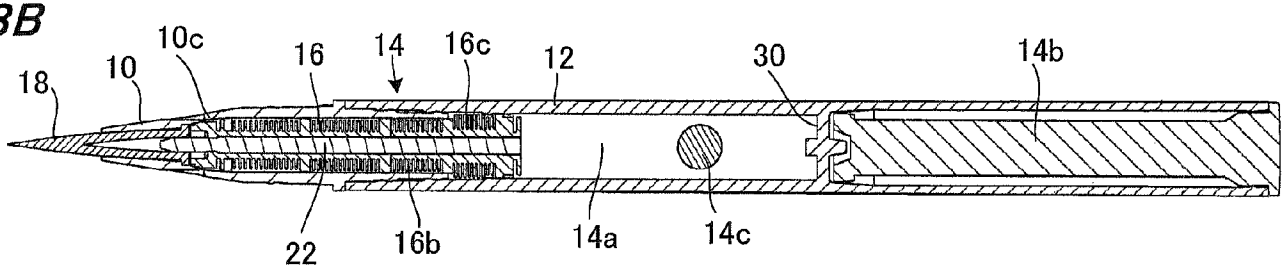
Figure 8C:
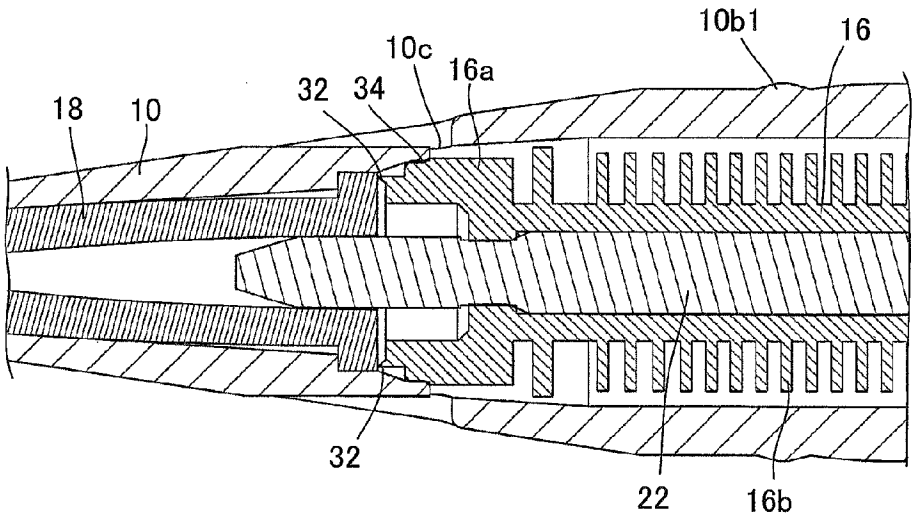

FIGS. 7A and 7B are overall illustrative diagrams of a collector-type applicator implement according to another embodiment (the second embodiment) of the present invention. FIGS. 8A to 8C are state illustrating diagrams showing the collector-type applicator implement with its cap removed. In the collector-type applicator implement according to the second embodiment shown in FIGS. 7A to 8C, the same components as those of the above first embodiment shown with FIGS. 1A to 6B are allotted with the same reference numerals.

A difference of the collector-type applicator implement according to the second embodiment from the collector-type applicator implement of the first embodiment shown in FIG. 1B is in that a middle wall 30 is formed in the approximate center of the length of main barrel 12 in the rear part of barrel body 14 as shown in FIGS. 7B and 8B.

Provision of this middle wall 30 prevents the application liquid from flowing through between barrel body 14 and tail plug 14*b*. Here, the middle wall 30 is formed at the radial center thereof with studs projected forward and rearward while a pit is formed on the front endface of tail plug 14*b* that is fitted to the stud from the rear of barrel body 12, so that the stud on the rear side can be prevented from interfering by the pit.

Another difference is in that an annular thin elastic projection 32 projected forward is formed along the circumference in the front end of collector 16, specifically, in the front endface of bowl-shaped part 16*a*. This elastic projection 32 annularly abuts the rear endface of writing part 18 so that the writing part 18 is fixed flexibly by the elastic force of the elastic projection 32.

Further, the outer periphery in the front part of collector 16 is put in hermetic contact with the inner wall of front barrel 10. Specifically, the outer peripheral surface of bowl-shaped part 16*a* formed in the front part of collector 16 creates an airtight portion (sealing portion) 34 with the interior surface of front barrel 10 by forming recess and projection engagement at a position close to and in front of air replacement hole 10*c*, at the position the outer peripheral surface of bowl-shaped part 16 abutting the interior surface of the front barrel 10. Since this airtight portion 34 is located in front of air replacement hole 10*c*, the external air passing through air replacement hole 10*c* will not flow to the writing part 18 side which is located in front of bowl-shaped part 16*a* of collector 16, hence the writing part 18 becomes hard to dry. It goes without saying that the external air is enabled to readily enter the front temporary collecting part 16*b* and rear temporary collecting part 16*c* of collector 16.

The Third Embodiment

Figure 9A:
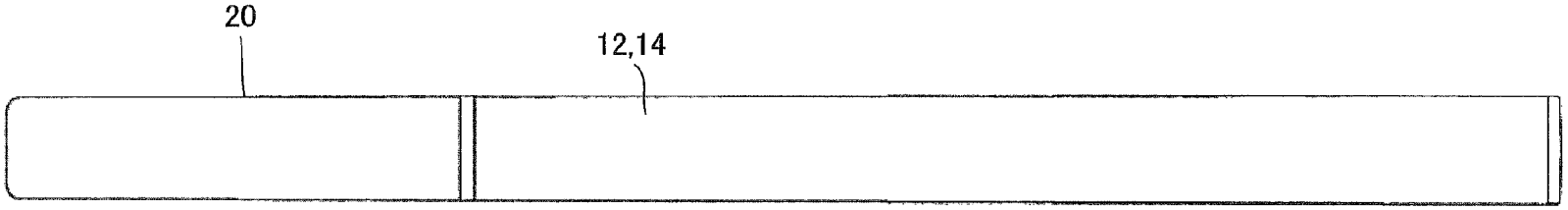
FIG. 9A is an overall side view of a collector-type applicator implement according to still another embodiment (the third embodiment) of the present invention, and FIG. 9B an overall vertical section of the same.
Figure 9B:
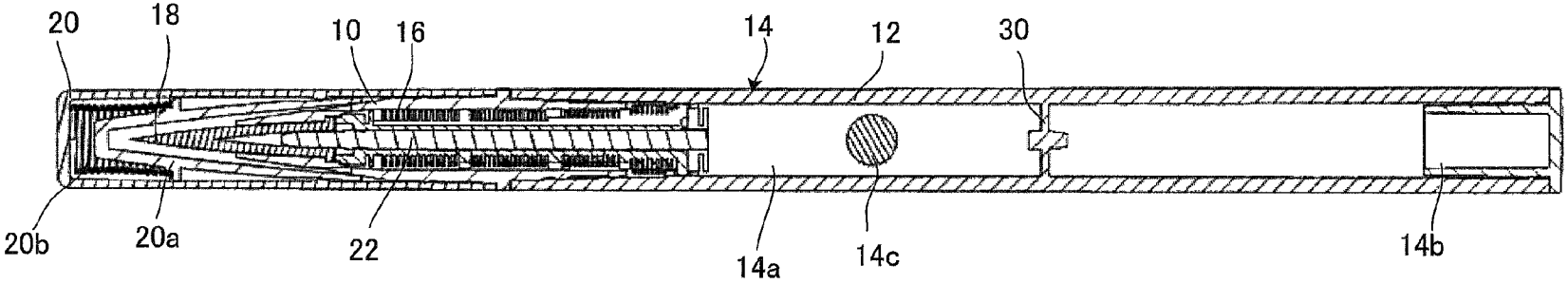
Figure 12B:
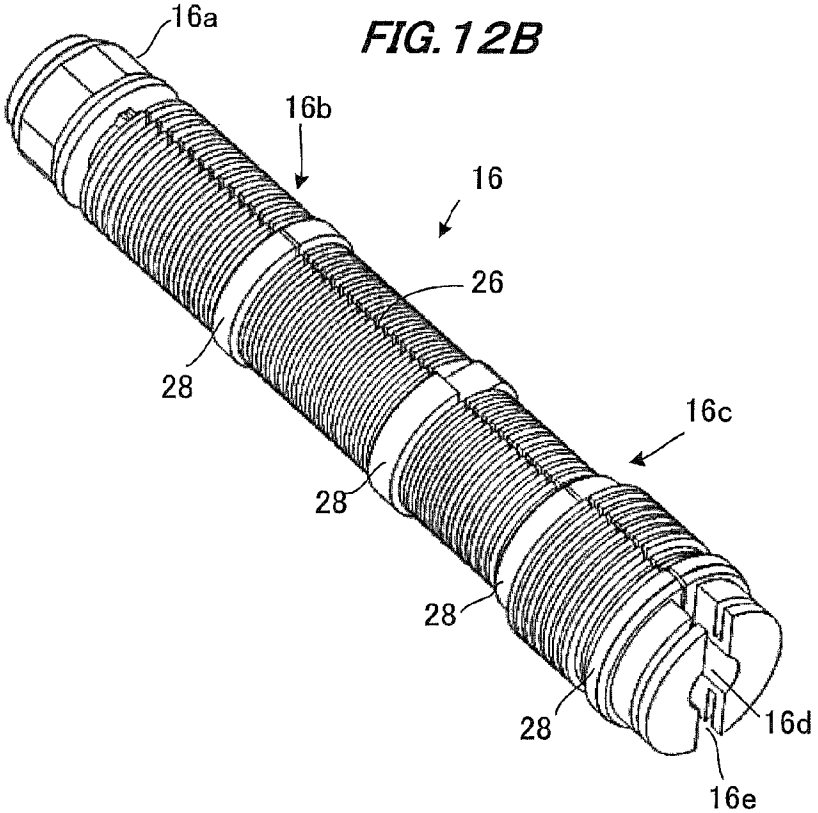
Figure 12A:
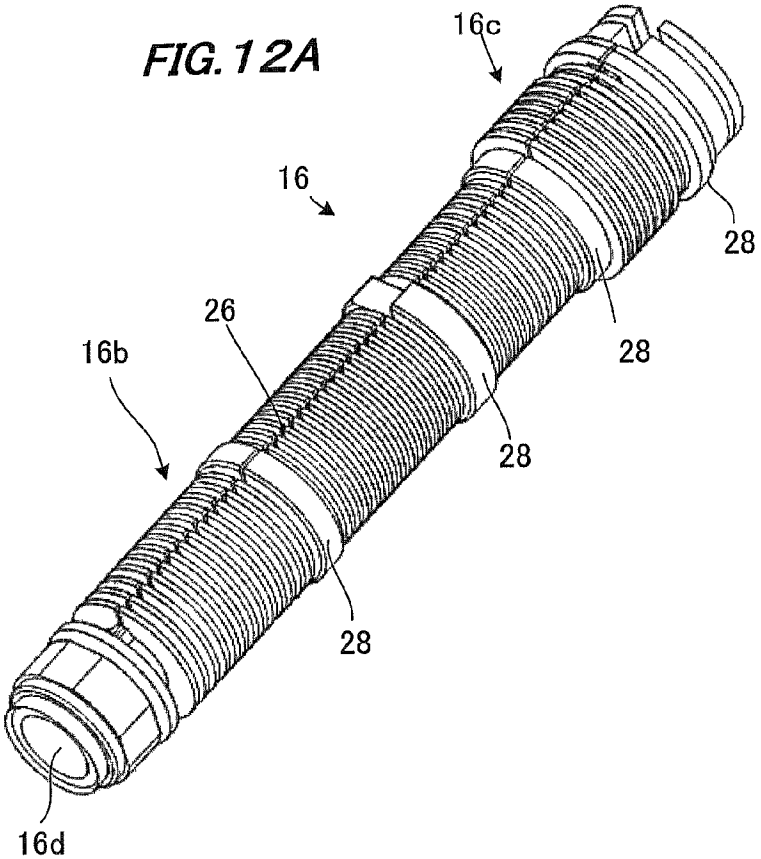

FIGS. 9A and 9B are overall illustrative diagrams of a collector-type applicator implement according to another embodiment (the third embodiment) of the present invention. FIGS. 10A to 10D are state illustrating diagrams showing the collector-type applicator implement with its cap removed. FIGS. 11A to 11H are part drawings of a collector of the collector-type applicator implement. FIGS. 12A and 12B are perspective views showing the collector. The same components as those of the above second embodiment shown with FIGS. 7A to 8C are allotted with the same reference numerals.

Figure 10A:
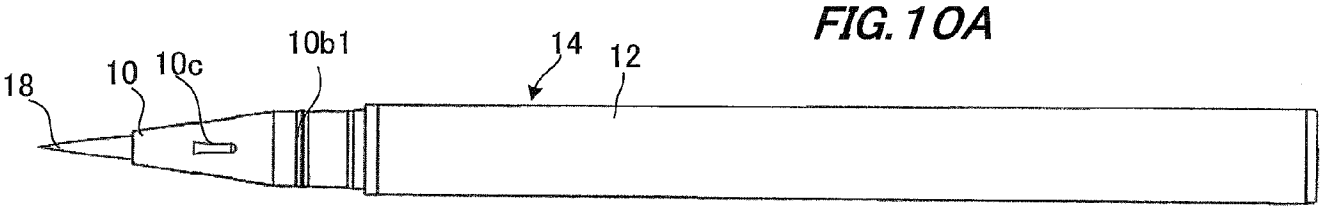
FIG. 10A is an overall side view showing the collector-type applicator implement of FIG. 9A with its cap removed, FIG. 10B an overall vertical section of the same, FIG. 10C a cross-section cut along line C-C in FIG. 10B, and FIG. 10D an enlarged vertical section of a portion from the writing part to the collector.
Figure 10B:
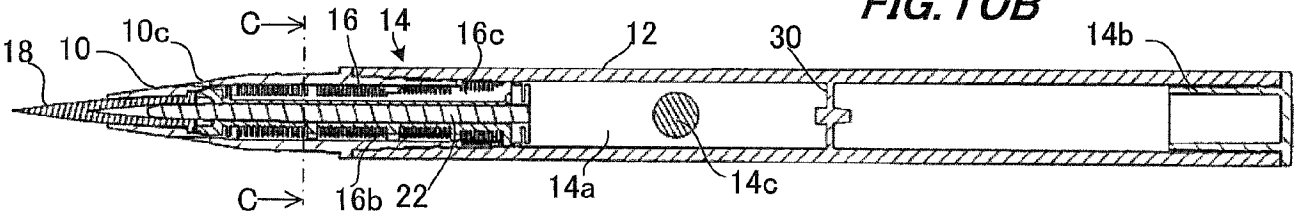

The collector-type applicator implement according to the third embodiment is different from the collector-type applicator implement according to the second embodiment shown in FIGS. 7A to 8C, in that, as shown in FIGS. 9B and 10B, tail plug 14*b* is shorter than that of the second embodiment and the engagement between barrel body 14 and tail plug 14*b* is formed only at the rear end of barrel body 14, and in that clearance 36 is created between the supports of center core 22 in hollow portion 16*d* in the center shaft of collector 16.

Figure 10C:
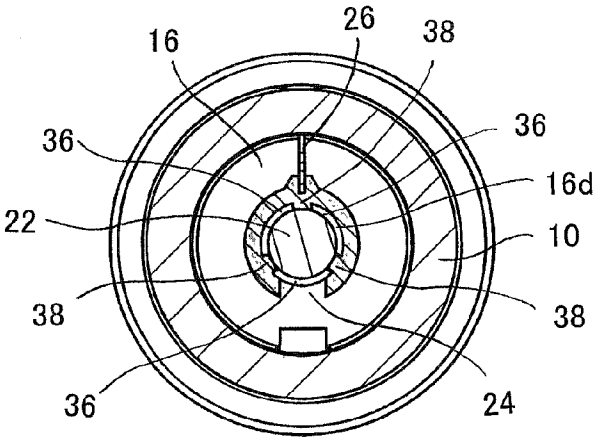
Figure 10D:
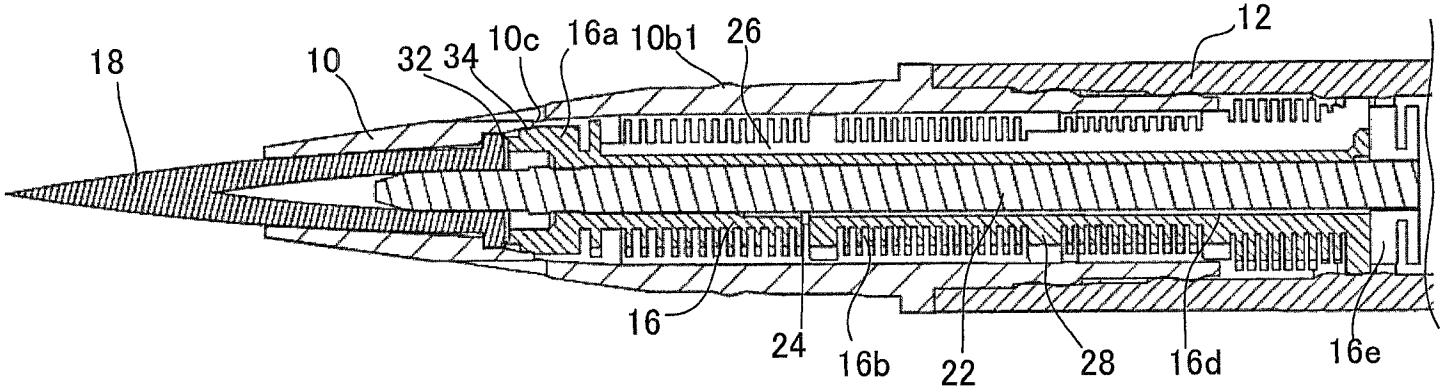

That is, as shown in FIG. 10C, three ribs 38 (the number of ribs 38 is preferably plural equal to three or more) are arranged equi-angularly with respect to circumferential direction on the wall position that defines hollow portion 16*d* of collector 16 and projected inward or toward the axial center from the inner surface of the wall portion.

In the state where center core 22 is fitted in the hollow portion 16*d*, the aforementioned three ribs 38 support center core 22 on their ridges so as to hold the center core 22 without bending. Specifically, rib 38 is projected with a short height and a narrow width toward the axis of the hollow portion 16*d* from the inner peripheral surface of the wall portion defining hollow portion 16*d* in collector 16, and elongated (or a series of dots or lines element maybe arranged) in the length direction of collector 16. Provision of these three ribs 38 create clearance 36 between the inner peripheral surface of hollow portion 16*d* and the outer peripheral surface of center core 22 and facilitate air replacement, whereby it is possible to improve application performance of the liquid.

In the rear end of collector 16, as shown in FIGS. 11E, 11H and 12B, a cutout 16*e* is formed on the circumferentially opposite side from slit 26 and connected to the hollow portion 16*d*. When collector 16 has been assembled, the rear end of collector 16 faces storage space 14*a* of barrel body 14 so that both slit 26 and cutout 16*e* are in contact with the application liquid.

Upon replacement of air, the air outside the applicator implement (the outside air) enters from air replacement hole 10*c* in front barrel 10, passing through between the inner periphery of front barrel 10 and the outer periphery of collector 16 and through hole 24 to reach clearance 36 between ribs 38.

The air passing through the clearance 36 flows into storage space 14*a* of barrel body 14 from the rear end of collector 16 such as the aforementioned cutout 16*e*.

In this embodiment, slit 26 as a passage for liquid and through hole 24 as an air replacement potion (air/liquid replacement portion) are provided at different positions in collector 16.

Accordingly, when the application liquid in storage space 14*a* decreases as the collector-type applicator implement of the embodiment is used, the air channel through the clearance 36 connects to storage space 14*a* so that air replacement (air/liquid replacement) can be smoothly performed.

As to support of center core 22, provision of three or more ribs 38 enables center core 22 to be arranged equally apart from the inner peripheral surface of hollow portion 16*d*, so that it is possible to diminish the curving and displacement of center core 22. Here, as long as center core 22 can be supported being less crooked to create clearance 36, it is of course possible to form ribs 38 at any intervals as appropriate.

According to the collector-type applicator implements of the first to third embodiments, collector 16 is held by front barrel 10 and barrel body 12 so that collector 16 is projected from front barrel 10 to thereby secure an adequate amount of ink storage in collector 16. As a result, it is possible to realize a collector-type applicator implement of a narrow barrel that makes the best use of inherent performance of collector 16.

Further, according to the present invention, it is possible to provide a thin-barrel collector-type applicator implement, especially eyeliner, which can present equivalent performance to that of the conventional thick-barrel applicator implement. When used as an eye line, this thin collector-type applicator implement presents stylish appearances and enables the user to apply thick and clear eyeliner until end of use thanks to the adoption of a collector configuration.

INDUSTRIAL APPLICABILITY

The applicator implement of the present invention can be applied to general applicator implements, but especially made use of for eyeliner liquid that is low in viscosity.

DESCRIPTION OF REFERENCE NUMERALS

10 front barrel
12 main barrel
14 barrel body
14*a* storage space
16 collector
16*a* bowl-shaped part
16*b* front temporary collector
16*c* rear temporary collector
16*d* hollow portion

18 writing part
20 cap
22 center core
24 through hole
26 ink groove (slit)
28 supporting wall
30 middle wall
32 elastic projection of collector
34 airtight portion of collector
38 rib

What is claimed is:

1. A collector-type applicator implement comprising:

a barrel body comprising:

a front barrel; and a main barrel on a rear side of the front barrel, the main barrel being fitted with the front barrel, a collector having comb-like fins and arranged in a front part of the barrel body; and, a storage space defined in a rear part of the barrel body for storing an application liquid, wherein the collector is covered by the front barrel and the main barrel and configured to be held inside the barrel body, and a thick supporting wall abutting an inner surface of the front barrel is formed ever plural number of fins of the collector, and the outside diameter of the collector is varied stepwise by the thick supporting wall.

2. The collector-type applicator implement according to claim 1, wherein an outside diameter in a rear part of the collector is greater than an outside diameter in a front part of the collector.

3. The collector-type applicator implement according to claim 2, further comprising a center core disposed inside the collector to lead the application liquid from the storage space to a writing part, wherein the center core is not projected from a rear end of the collector into the storage space.

4. The collector-type applicator implement according to claim 2, wherein an elastic thin projection is formed in a front end of the collector that abuts a writing part.

5. The collector-type applicator implement according to claim 1, wherein an outer periphery of the front part of the collector is put in hermetic contact with an inner wall of the front barrel.

6. The collector-type applicator implement according to claim 1, further comprising a center core disposed inside the collector to lead the application liquid from the storage space to a writing part, wherein a plurality of ribs are provided in a hollow portion of the collector and projected inwardly in the hollow portion, and the center core is inserted in the hollow portion.

* * * * *